US010794102B2

(12) United States Patent
Vanini

(10) Patent No.: US 10,794,102 B2
(45) Date of Patent: Oct. 6, 2020

(54) HINGE FOR DOORS OF DOMESTIC APPLIANCES

(71) Applicant: NUOVA STAR S.p.A., Zola Predosa (Bologna) (IT)

(72) Inventor: Marco Vanini, Bologna (IT)

(73) Assignee: NUOVA STAR S.P.A., Zola Predosa (Bologna) (IT)

( * ) Notice: Subject to any disclaimer, the term of this patent is extended or adjusted under 35 U.S.C. 154(b) by 0 days.

(21) Appl. No.: 16/278,497

(22) Filed: Feb. 18, 2019

(65) Prior Publication Data

US 2019/0323276 A1 Oct. 24, 2019

(30) Foreign Application Priority Data

Apr. 24, 2018 (IT) ..... 102018000004849

(51) Int. Cl.
*E05F 1/14* (2006.01)
*E05F 1/12* (2006.01)
(Continued)

(52) U.S. Cl.
CPC ..... *E05F 1/12* (2013.01); *E05F 3/20* (2013.01); *E05F 5/02* (2013.01);
(Continued)

(58) Field of Classification Search
CPC ... F16F 15/03; F16F 6/00; F16F 6/005; F24C 15/02; F24C 15/023; E05F 1/1276; E05F 1/1292; E05F 1/1261; E05F 1/1253; E05Y 2201/41; E05Y 2201/412; E05Y 2201/414; E05Y 2201/416; E05Y 2201/40; E05Y 2201/46; E05Y 2900/308; E05D 11/1064
See application file for complete search history.

(56) References Cited

U.S. PATENT DOCUMENTS 5,075,923 A * 12/1991 Taylor ..... E05C 17/28 16/49
9,995,075 B2 * 6/2018 Vanini ..... E05F 5/00
(Continued)

FOREIGN PATENT DOCUMENTS

EP 1302150 A1 4/2003
EP 3293332 A1 3/2018

OTHER PUBLICATIONS

Italian Search Report dated Dec. 10, 2018 for counterpart Italian Application No. IT 201800004849.

*Primary Examiner* — Chuck Y Mah
(74) *Attorney, Agent, or Firm* — Shuttleworth & Ingersoll, PLC; Timothy J. Klima

(57) ABSTRACT

A hinge for doors of electrical household appliances, including a box-shaped element and a first lever pivoted on the box-shaped element by means of a pin; one of either the box-shaped element or the first lever being fixable to a frame and the other being fixable to a door, to make the door tiltably movable relative to the frame between a closed position and an open position; first elastic means supported by the box-shaped element and designed to apply an elastic action on the first lever, a rod for connecting the first lever to the first elastic means, positioned in a slidable fashion inside the box-shaped element; a hydraulic damping member for applying a damping action during the reciprocal motion between the first lever and the box-shaped element.

8 Claims, 7 Drawing Sheets

(51) Int. Cl.
*E05F 5/02* (2006.01)
*E05F 3/20* (2006.01)

(52) U.S. Cl.
CPC ..... *E05Y 2201/254* (2013.01); *E05Y 2900/30* (2013.01); *E05Y 2900/606* (2013.01)

(56) References Cited

U.S. PATENT DOCUMENTS

| | | | | |
|---|---|---|---|---|
| 2007/0283532 | A1* | 12/2007 | Vanini | E05F 1/1261 16/277 |
| 2008/0289144 | A1* | 11/2008 | Vanini | F24C 15/023 16/221 |
| 2010/0109497 | A1* | 5/2010 | Blersch | F25D 23/028 312/405 |
| 2010/0281650 | A1* | 11/2010 | Kleemann | E05F 3/20 16/64 |
| 2012/0067333 | A1* | 3/2012 | Mirshekari | E05F 1/1041 126/192 |
| 2014/0130302 | A1* | 5/2014 | Bettinzoli | E05F 1/1261 16/304 |
| 2014/0345082 | A1 | 11/2014 | Collene et al. | |
| 2016/0230438 | A1* | 8/2016 | Collene | E05F 1/1261 |
| 2016/0273777 | A1* | 9/2016 | Kim | F24C 15/023 |

* cited by examiner

HINGE FOR DOORS OF DOMESTIC APPLIANCES

This application claims priority to Italian Patent Application IT102018000004849 filed Apr. 24, 2018, the entirety of which is incorporated by reference herein.

BACKGROUND OF THE INVENTION

This invention relates to a hinge for doors of domestic appliances.

More specifically, this invention relates to a hinge for electric household appliances equipped with an internal damper.

This specification describes the hinge according to the invention with reference to an oven purely by way of example and without restricting the scope of the inventive concept.

In the ovens of known type, the hinges used normally comprise a box-shaped structure connected by a kinematic mechanism to a lever, with the lever and the box-shaped structure designed to open mutually in a tilting fashion.

The box-shaped structure and the lever are designed so as to be connected one to a door and the other to a frame of the oven.

More in detail, one between the box-shaped structure and the lever is fixed to the frame of the oven, at a side of the access opening of the latter, whilst the other is fixed to an edge of the door, which in this way is made tiltably movable relative to the above-mentioned frame.

Elastic elements act on the above-mentioned lever which influence the movement of the door during both opening and closing.

When the oven door is tilted away from the closed position, the elastic elements oppose, firstly, the movement which detaches the door from the oven mounting frame and, secondly, the subsequent rotational movement of the door and its consequent lowering to the position in which the access opening of the oven is fully open. During the second part of its opening movement, the door, under the combined action of its weight, which tends to pull it downwards, and of the elastic elements, which oppose this downward pulling action, is thus made to turn gradually.

When the oven door is tilted up from the fully open limit position, the action of the elastic elements is first balanced by the weight of the door, thus initially ensuring that it turns gradually towards the closed position. After that, however, if the user is not careful to slow the door down, the force of the elastic elements tends to push it forcefully towards the oven frame, causing it to slam shut, often rather suddenly and noisily.

For this purpose, that is to say, for applying a braking action, suitable damping means have been introduced in the hinges.

The use of internal dampers in hinges in order to slow the closing or opening of the door is well known in the prior art.

The introduction of these damper elements in the hinges for electric household appliances has given rise to numerous problems.

A first drawback is due to the difficulty of inserting damping members in the limited space available for housing the hinges which are actually effective and long-lasting.

It is clear that the damping capacity of a damping member must take into consideration its actual dimensions.

The prior art dampened hinges often have quite articulated actuation mechanisms and comprise a plurality of dynamically connected elements.

Moreover, the clearances naturally existing between these elements cause imprecisions in the actuation of the damping member and this circumstance easily leads to irregularities in the operation of the hinge and, more generally speaking, the electrical household appliance as a whole.

The problems mentioned above are particularly evident in the case of hinges having shock absorbing members acting both in the opening and closing directions, which have even more complex drive mechanisms.

Moreover, even though existing solutions of dampened hinges sometimes demonstrate themselves to be sufficiently efficient from the functional point of view they are at the same time relatively complex when assembling.

SUMMARY OF THE INVENTION

The aim of this invention is to provide a dampened hinge for doors of domestic appliances which is free of the above-mentioned drawbacks and is, at the same time, structurally simple and practical and effective to use.

A further aim of the invention is to provide a dampened hinge for electric household appliances wherein the actuation of the damping member is performed in a controlled manner and through a limited number of mechanical parts.

Another aim of the invention is to provide a dampened hinge for domestic appliances the assembly of which is simple and practical.

Another aim of the invention is to provide a dampened hinge for domestic appliances which is versatile and adaptable to different requirements.

The technical features of the invention, with reference to the above aims, can be easily inferred from the appended claims, in particular claim 1, and preferably any of the claims that depend, either directly or indirectly, on claim 1.

BRIEF DESCRIPTION OF DRAWINGS

The advantages of the invention are more apparent from the detailed description which follows, with reference to the accompanying drawings which illustrate a preferred, non-limiting example embodiment of the invention and in which.

DESCRIPTION OF PREFERRED EMBODIMENTS

Figure 1:
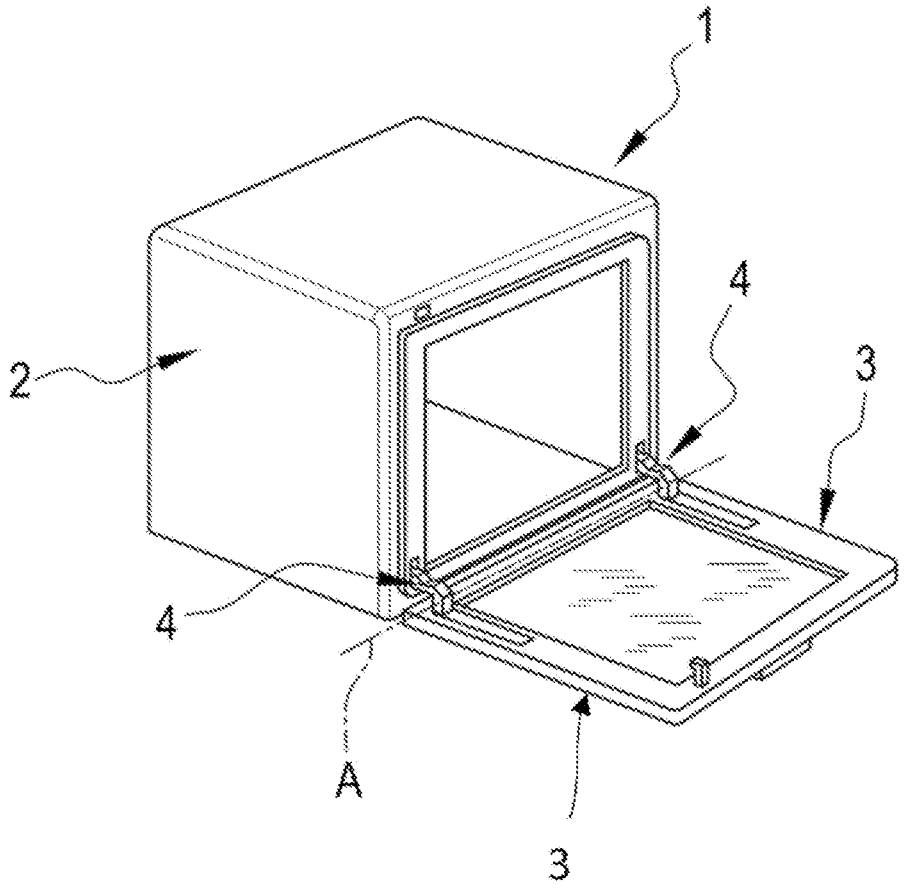
FIG. 1 is a schematic perspective view from above of an oven with a door connected to it by two hinges made in accordance with the invention.

The numeral 1 in FIG. 1 denotes in its entirety an oven comprising a frame 2 to which a door 3 is connected by two hinges 4 which enable it to be tiltably rotated about a horizontal axis A.

FIGS. 2 to 6 show a preferred embodiment of a hinge 4 made according to the invention.

Each of the two hinges 4 comprises a first lever 5, fixed to the frame 2 of the oven 1 at a respective side of the access opening of the latter, and an box-shaped element 6, fixed to a respective edge of the door 3.

The first lever 5 is fixed to the frame 2 either directly or by interposing a respective box-shaped body not illustrated.

The box-shaped element 6 has an elongate shape and extends lengthways along a predetermined direction D.

Advantageously, the box-shaped element 6 mainly has a C-shaped transversal cross-section.

Figure 3:
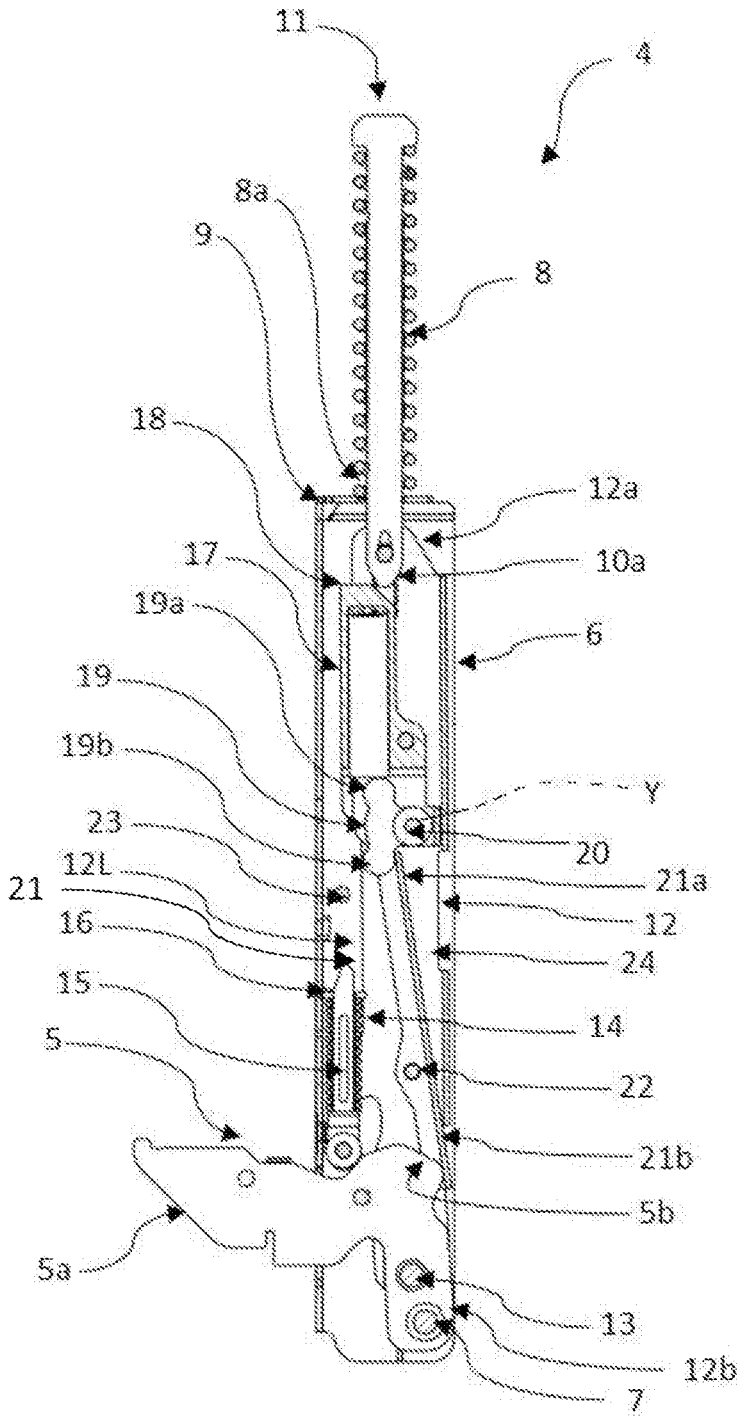
FIGS. 3 to 6 are respective schematic side elevation views of the hinge of FIG. 2 in four different positions of use.
Figure 6:
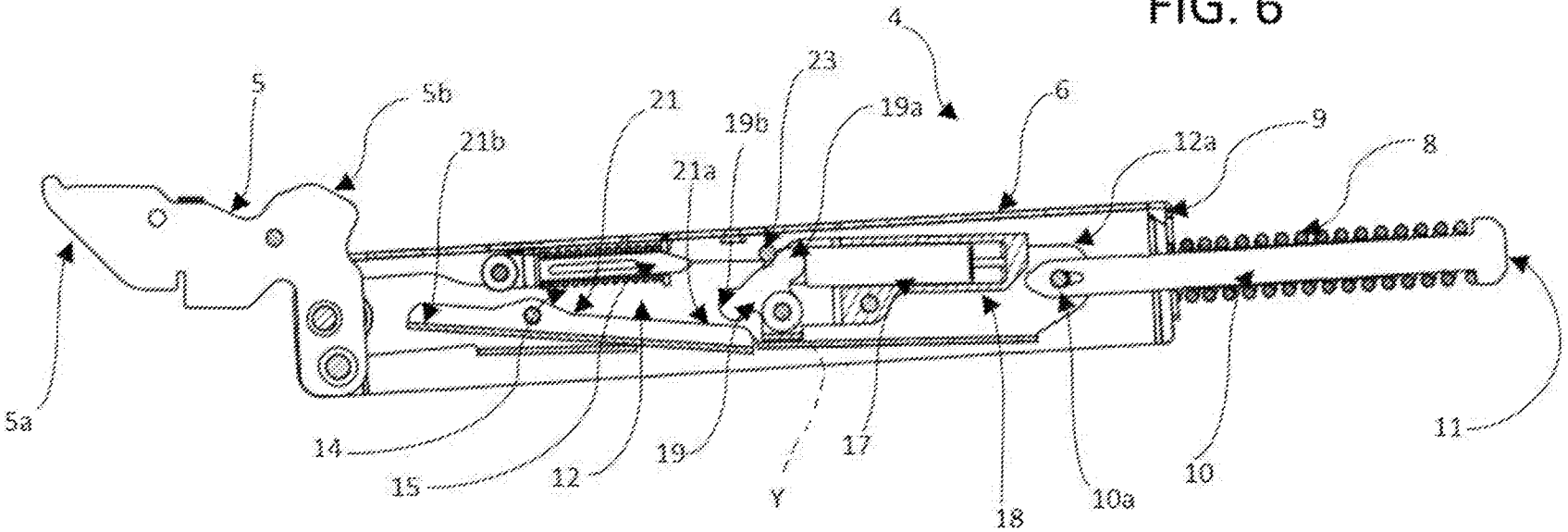

The first lever 5 is pivoted on the box-shaped element 6 by means of a pin 7 and has a portion 5*a* constrained rigidly to the frame 2 to make the door 3 tiltably movable relative to the frame 2, between a closed end position, illustrated in FIG. 3, and an open end position, illustrated in FIG. 6.

As illustrated in FIGS. 2 to 6, the hinge 4 comprises a first helical spring 8 housed outside the box-shaped element 6.

The first spring 8 designed to abut, with a relative lower end turn 8*a*, with a transversal end wall 9 of the box-shaped element 6.

The first spring 8 is kept in abutment against the above-mentioned transversal wall 9 by the head 11 of a compression rod 10 which is positioned coaxially inside the first spring 8 and which defines a guide for the first spring 8.

The first spring 8 defines, for the hinge 4, first elastic means designed to apply an elastic action on the first lever 5.

The compression rod 10 protrudes below from the first spring 8 with an end 10*a*, which passes through an opening made in the transversal wall 9 to couple, by means of a connecting element (not illustrated), to an upper end 12*a* of a connecting rod 12, acting as tie rod.

The connecting rod 12 has lower end 12*b* hinged to the first lever 5 by a pin 13 located near the above-mentioned pin 7.

The connecting rod 12 also has an elongate shape and extends lengthways along a direction substantially concordant with the above-mentioned predetermined direction D.

The connecting rod 12 is substantially box-shaped, meaning that its side walls 12L delimit a respective inner space.

The connecting rod 12 is slidably housed inside the box-shaped element 6.

The connecting rod 12 is advantageously made of sheet metal.

The position of the pin 13, at which the elastic reaction force of the first spring 8 is applied, relative to the pin 7, and the pre-compression of the first spring 8, guarantee an elastic action which tends to push the door 3 into its closed position.

With reference to the accompanying FIGS. 2 to 6, the hinge 4 comprises a second helical spring 14 fitted on a respective rod 15.

The second helical spring 14 and the related rod 15 are supported by the box-shaped element 6.

The rod 15 has an upper first end 15*a* inserted slidably in a suitable guide 16 integral with a wall of the box-shaped element 6.

Advantageously, the guide 16 is made on a folded metal sheet flap.

The rod 15 has a second lower end 15*b* supporting a roller 15*c*.

The roller 15*c* is designed to engage with a respective cam-shaped portion 5*b* of the first lever 5 for defining with it a cam-follower coupling.

The second helical spring 14, together with the respective rod 15 defines means for closing the hinge 4, that is to say, elastic means designed to guarantee the closed position of the door 3 of the oven as well as second elastic means designed to apply an elastic action on the first lever 5.

The hinge 1 comprises a hydraulic damping member 17 for applying a damping action during the reciprocal motion between the first lever 5 and the box-shaped element 6, in the proximity of reaching their above-mentioned mutual closed position.

The term hydraulic damping member is used to mean, in this description, any gas or fluid damping member, of substantially known type, wherein the gas or fluid slides from one chamber to another following the mutual movement of its two parts.

The hinge 1 advantageously comprises a cartridge 18 for containing the hydraulic damping member 17.

The cartridge 18 is removable, meaning that it is inserted already assembled inside the connecting rod 12 during assembly of the hinge 1.

The cartridge 18 is located stably inside the connecting rod 12.

Figure 7:
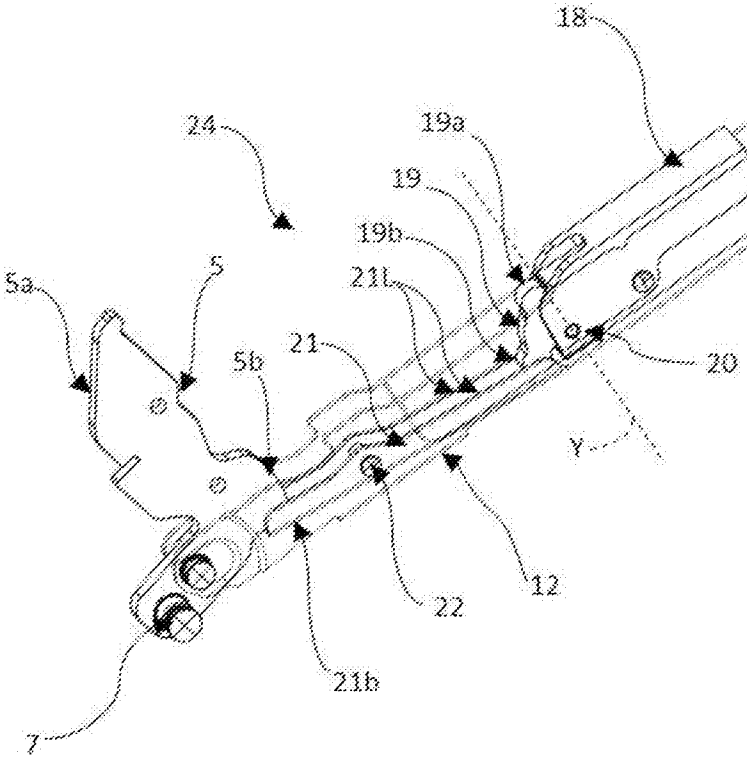

As illustrated in FIG. 7, the connecting rod 12 supports a second rocker lever 19 acting on the damping member 17.

The second rocker lever 19 is pivoted on a respective pin 20.

The pin 20 is fixed relative to the connecting rod 12.

Advantageously, according to the preferred embodiment illustrated, the pin 20 is integral with the cartridge 18 which, therefore, supports the second rocker lever 19.

The second rocker lever 19 is designed to oscillate about a respective pivot axis Y, passing through the pin 20 and perpendicular to the plane of the drawings.

The second rocker lever 19 has, on opposite sides of the pivot axis Y, a first arm 19*a* and a second arm 19*b*.

The first arm 19*a* is designed to engage with the above-mentioned damper cylinder 17.

Advantageously, the first arm 19*a* of the second rocker lever 19 has a rounded shape, to engage with a substantially flat surface of the damping member 17 without generating jamming.

The hinge 4 comprises a third oscillating lever 21 for controlling the second lever 19.

The third oscillating lever 21 is pivoted on a respective pin 22 integral with the connecting rod 12.

Figure 8:
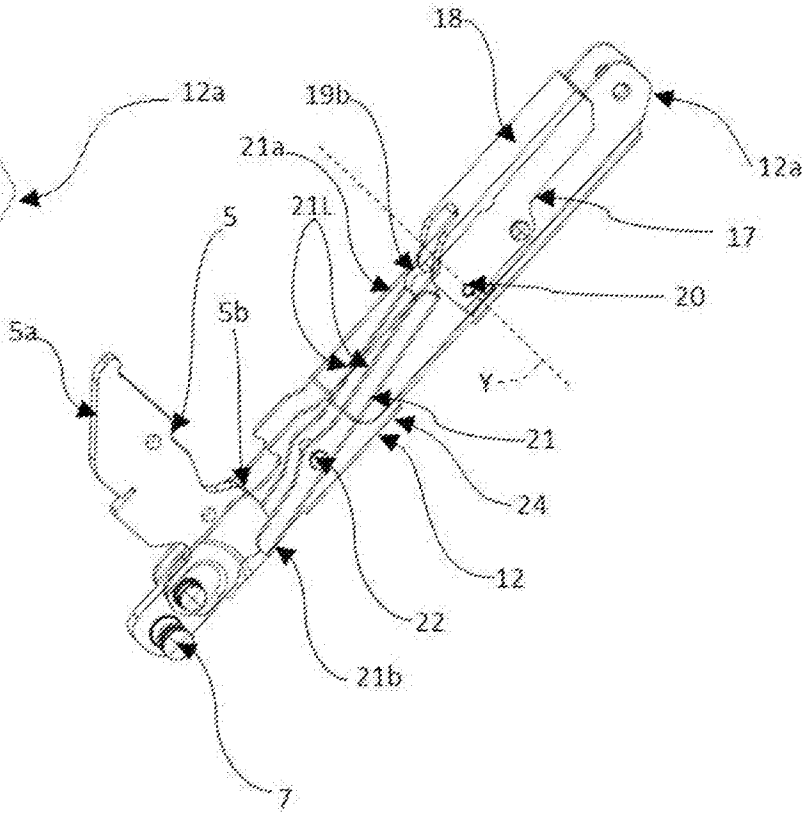
FIGS. 7 and 8 illustrate, in respective schematic perspective views, details of the hinge of the preceding drawings, in two different configurations of use and with some parts, with dashed lines, transparent.

As clearly illustrated in FIGS. 7, 8, the third oscillating lever 21 has a mainly longitudinal extension, which is box-shaped with a C-shaped cross-section.

The box-shaped "C" shape determines the presence, in the third oscillating lever 21, of two side walls 21L facing each other.

The third oscillating lever 21 has a first arm 21*a* designed to engage with the second arm 19*b* of the second rocker lever 19 and a second arm 21*b* designed to engage with the above-mentioned cam-shaped portion 5*b* of the first lever 5.

Advantageously, the second arm 19*b* of the second rocker lever 19 also has a rounded shape, to engage in a substantially rolling fashion on the flat surface of the first arm 21*a* of the third lever 21.

Advantageously, as illustrated in FIGS. 7 and 8, the box-shaped "C" shape of the third oscillating lever 21 usefully allows the stable engagement both with the cam-shaped portion 5*b* of the first lever 5 and with the second arm 19*b* of the second rocker lever 19. In effect, during their mutual engagement with respect to the third oscillating lever 21, both the portion 5*b* and the second arm 19*b* are interposed between the two side walls 21L and are therefore retained against undesired possible movements or lateral oscillations.

Figure 5:
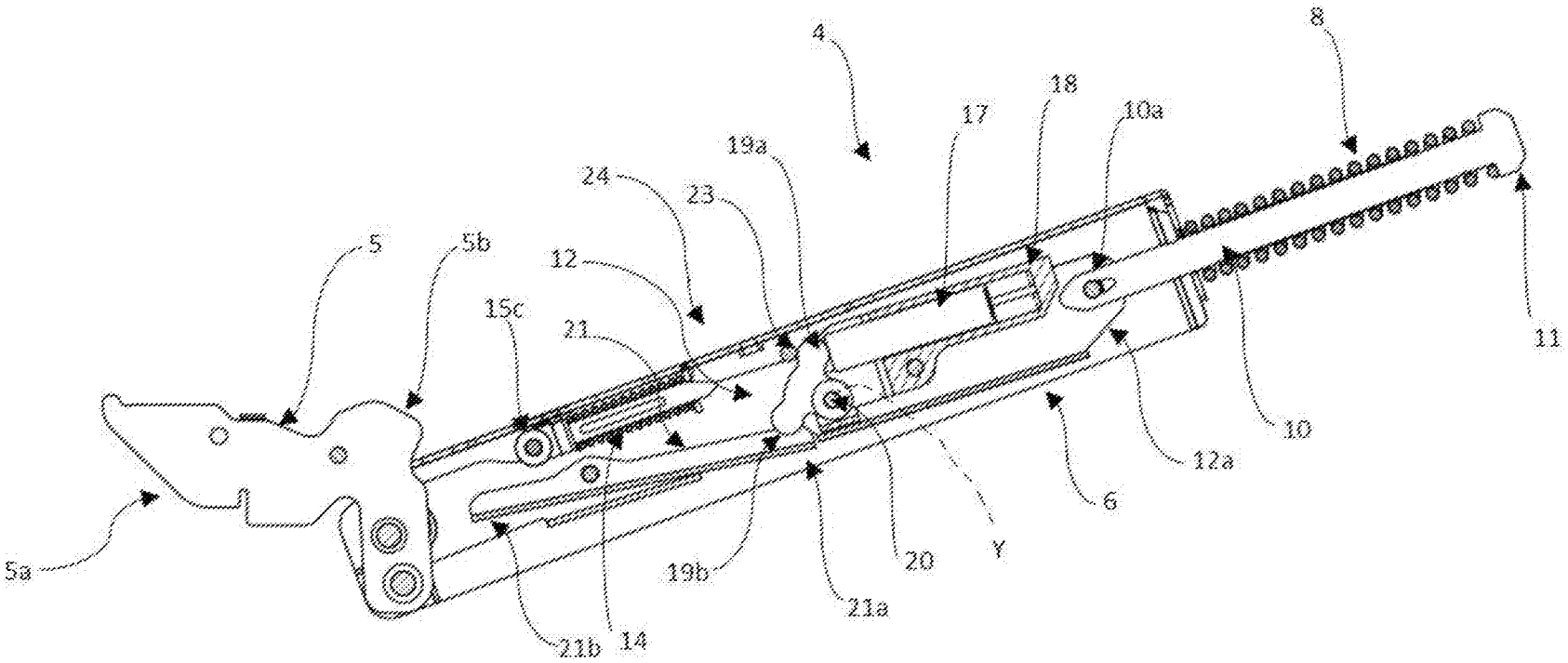

With reference to the FIGS. 5 and 6, in the proximity of reaching an open condition of the door 3, and therefore of the hinge 4, the second arm 19*b* is designed to engage in contact with a respective contact portion 23 fixed relative to the box-shaped element 6.

In the embodiment illustrated in the accompanying drawings, the above-mentioned contact portion 23 is formed on the box-shaped element 6.

Advantageously, the above-mentioned contact portion 23 is defined by a pin connected to two side walls of the box-shaped element 6 and extending perpendicularly to the plane of FIG. 6.

According to embodiments not illustrated, the contact portion is defined by a tooth made by folding a flap of the central wall of the box-shaped element 6, the tooth facing the space inside the box-shaped element 6.

The above-mentioned second rocker lever 19, third oscillating lever 21 and contact portion 23 define, for the hinge 4, respective means 24 for actuating the damping member 17.

The operation of the hinge 4 is briefly described below.

Figure 4:
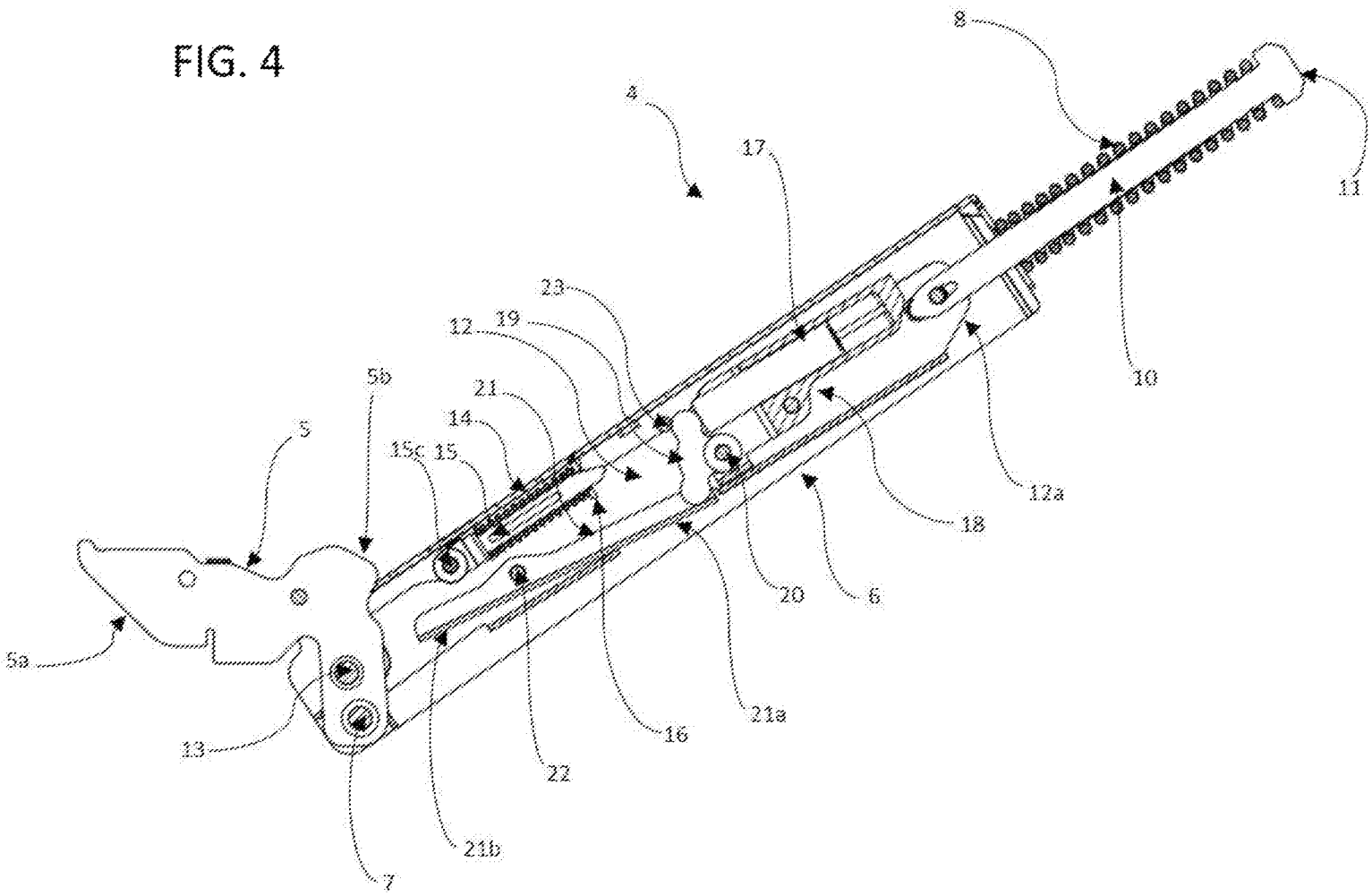

Starting from a position of partial opening of the door 3, for which the corresponding configuration of the hinge 4 is illustrated in FIG. 4, a rotation of the door 3 towards the closed position is favoured by the action of the helical spring 8 and is initially obstructed by the weight of the door 3.

In the configuration of the hinge 4 illustrated in FIG. 4 the damping member 17 is not yet activated.

Figure 2:
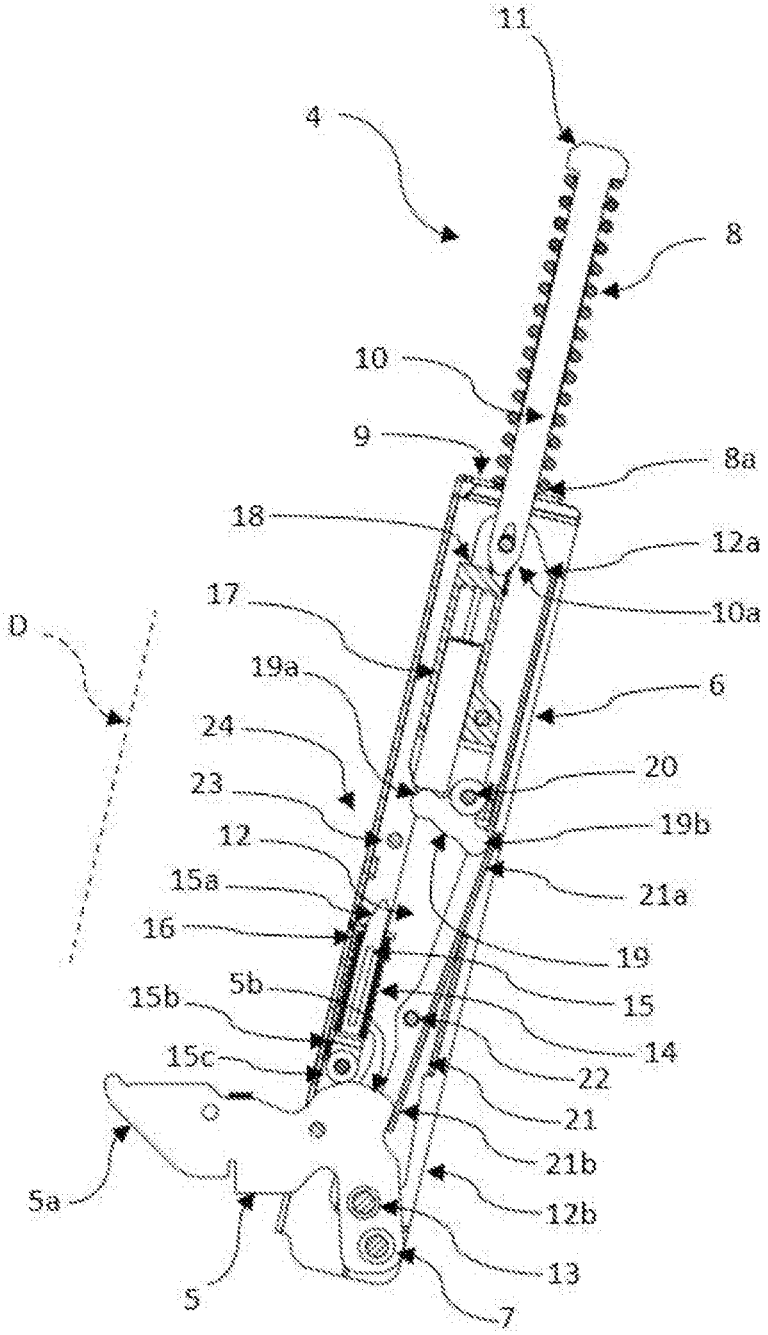
FIG. 2 is a schematic side elevation view, with some parts in cross-section or transparent, to better illustrate others, of a preferred embodiment of the hinge according to the invention.

FIG. 2 shows the hinge 4 in a further intermediate closing position of the door 3, at which the cam-shaped portion 5*b* of the first lever 5 comes into contact with the roller 15*c* of the rod 15, in known fashion, for compressing the second helical spring 14.

In the configuration just described, as also illustrated in detail in FIG. 7, as a result of the relative sliding between the connecting rod 12 and the box-shaped element 6, a contact is established between the cam-shaped portion 5*b* and the second arm 21*b* of the third lever 21.

Starting from the first contact configuration and continuing with the closing of the door 3, the cam-shaped portion 5*b* applies a pushing action on the third lever 21 at its second arm 21*b*, the pushing causing a rotation (in an anticlockwise direction with reference to FIGS. 3 and 4) of the third lever 21 about the relative pin 22.

Following this rotation, the first arm 21*a* of the third lever 21 engages with the second arm 19*b* of the second rocker lever 19 and determines a rotation (in a clockwise direction with reference to FIGS. 2 and 3) of the second lever 19 on the relative pin 20.

Following this rotation of the rocker lever 19 about the respective pivot axis Y, the relative first arm 19*a* applies a corresponding pushing action on the damping member 17.

This pushing, since the cartridge 18 is fixed in an integral fashion to the connecting rod 12 determines the compression of the damping member 17 which, consequently, applies its action for damping the reciprocal motion between the first lever 5 and the connecting rod 12.

The damping action is different from the closing action performed by the springs 8, 14 and makes the movement of the door 3 towards the completely closed position both gradual and slowed down.

It is evident that even in the absence of a braking action by the user, the door 3, pushed by the springs 8, 14 towards the frame 2 of the oven 1, reaches this in a smooth and silent manner thanks to the end of stroke damping performed by the damping member 17.

As illustrated in FIGS. 5 and 6, during the step of opening of the door 3, during which the helical spring 8, being compressed, balances the weight force of the door, it is worth damping the movement of the door when reaching its fully open position.

For this purpose, according to the preferred embodiment illustrated in the accompanying drawings, and as described above, the hinge 4 according to the invention has the above-mentioned contact portion 23.

With reference to FIG. 5, in the proximity of reaching an open condition of the door 3, and therefore of the hinge 4, the second arm 19*b* of the second rocker lever 19 engages in contact with the contact portion 23 of fixed relative to the box-shaped element 6.

Following the relative sliding movement between the connecting rod 12 (which is integral with the damping member 17) and the box-shaped element 6 (which is integral with the pin defining the contact portion 23) and by the interposition of the second arm 19*b* of the second lever 19, the contact portion 23 determines a pushing action of the damping member 17.

This pushing, since the cartridge 18 is fixed in an integral fashion to the connecting rod 12 determines the compression of the damping member 17 which, consequently, applies its action for damping the reciprocal motion between the connecting rod 12 and the box-shaped element 6.

The damping action is concordant with the balancing action by the spring 8 and thus contributes to make gradual and braked the opening movement of the door 3 towards the fully open position at which there is the maximum moment exerted by the weight force.

The hinge according to the invention achieves the preset aims and brings important advantages.

A first advantage is due to the fact that an extremely simple construction of the hinge 4 is obtained by positioning the damping member 17 and the second and third levers 19, 21 on the connecting rod 12.

In effect, thanks to this fact, the assembly of these elements on the connecting rod 12 can be easily performed beforehand, before assembling the hinge 4, thereby making the latter a particularly simple operation.

Moreover, a very compact and solid structure is obtained by means of the third pivoted lever 21 on the connecting rod 12. The box-shaped construction of the third connecting rod 21 also contributes to increasing the solidity of the assembly as well as the fluidity of movement.

Advantageously, in effect, by positioning both the cam portion 5*b* and the second arm 19*b* of the second lever 19 between the two side walls 21L of the third lever 21, their relative movement is substantially guided and only limited lateral oscillations are possible.

According to a simplified embodiment, not illustrated, of the hinge according to the invention, it does not comprise the above-mentioned first elastic means 8 as motor-driven movement means may be advantageously combined.

What is claimed is:

1. A hinge for doors of electrical household appliances, comprising:

a box-shaped element and a first lever pivoted on the box-shaped element via a pivot; one of either the box-shaped element or the first lever being fixable to a frame and the other of either the box-shaped element or the first lever being fixable to a door, to make the door tiltably movable relative to the frame between a closed position and an open position;

a first spring supported by the box-shaped element and configured to apply an elastic action on the first lever, a connecting rod for connecting the first lever to the first spring, the connecting rod being slidably positioned inside the box-shaped element;

a hydraulic damping member for applying a damping action during a reciprocal motion of the first lever and the box-shaped element in a proximity of reaching at least one of the open and closed positions, the hydraulic damping member being positioned inside overall dimensions of the box-shaped element;

an actuator for actuating the damping member, the actuator comprising a second rocker lever supported by the connecting rod and a third oscillating lever for controlling the second rocker lever, the third oscillating lever having a first arm configured for engaging with the second rocker lever and a second arm configured for engaging with a portion of the first lever.

2. The hinge according to claim 1, wherein the third oscillating lever is pivoted on the connecting rod.

3. The hinge according to claim 1, wherein the second rocker lever has a first arm and a second arm, with the first arm acting on the hydraulic damping member, wherein the third oscillating lever is configured to engage with the second arm of the second rocker lever.

4. The hinge according to claim 3, wherein the actuator comprise, integral with the box-shaped element, a contact portion configured for engaging with the second arm of the second rocker lever, for pushing the first arm of the second rocker lever against the hydraulic damping member.

5. The hinge according to claim 1, wherein the connecting rod supports a second spring configured to apply an elastic action on the first lever.

6. The hinge according to claim 1, further comprising a cartridge for containing the hydraulic damping member, the cartridge being fixed to the connecting rod.

7. The hinge according to claim 6, and further comprising a pin attached to the cartridge, the pin rotatably supporting the second rocker lever on the cartridge.

8. The hinge according to claim 1, wherein the third oscillating lever has a C-shaped transversal cross-section.

* * * * *